US005438770A

United States Patent [19]

Miller

[11] Patent Number: 5,438,770

[45] Date of Patent: Aug. 8, 1995

[54] SNOWBLOWER

[76] Inventor: Donald L. Miller, 307 Stueben St., Horseheads, N.Y. 14845

[21] Appl. No.: 109,836

[22] Filed: Aug. 20, 1993

[51] Int. Cl.[6] ..... E01H 5/10

[52] U.S. Cl. ..... 37/227; 37/249

[58] Field of Search ..... 74/89.22; 37/232, 233, 37/243, 244, 253, 254, 256, 257, 258, 247, 248, 249, 250, 251; 180/9.21, 9.26, 9.28, 9.3

[56] References Cited

U.S. PATENT DOCUMENTS

| | | | |
|---|---|---|---|
| Re. 33,726 | 10/1991 | Thorud et al. . | |
| 396,430 | 1/1889 | Reichel | 74/89.22 |
| 1,508,716 | 9/1924 | Ochs | 37/233 |
| 1,722,531 | 7/1929 | Matter | 180/19.1 |
| 2,261,732 | 11/1941 | O'Brien . | |
| 2,319,008 | 5/1943 | McCormack | 180/9.3 |
| 2,572,775 | 10/1951 | Smith | 74/89.22 |
| 2,593,590 | 4/1952 | McNabb et al. | 74/89.22 |
| 3,189,021 | 6/1965 | Giguere . | |
| 3,423,856 | 1/1969 | Fiske | 37/244 |
| 3,465,455 | 9/1969 | Kiernan . | |
| 3,570,616 | 3/1971 | Tominaga | 180/9.3 X |
| 3,913,247 | 10/1975 | Ruhl | 37/251 X |
| 4,441,266 | 4/1984 | Westimayer | 37/244 |
| 4,694,594 | 9/1987 | Thorud et al. . | |
| 4,756,101 | 7/1988 | Friberg et al. . | |
| 4,836,320 | 6/1989 | Sundin . | |
| 4,978,068 | 12/1990 | Eldridge | 239/129 |
| 5,020,250 | 6/1991 | Fujii et al. | 37/257 |
| 5,095,996 | 3/1992 | Sprinkle | 172/42 |
| 5,174,053 | 12/1992 | Takeshita | 37/258 |

*Primary Examiner*—Randolph A. Reese
*Assistant Examiner*—Victor Batson
*Attorney, Agent, or Firm*—Remy J. VanOphem; John VanOphem

[57] ABSTRACT

An apparatus for improving the steering of a wheeled or track-driven machine, such as a snowblower, the apparatus having a levered wheel mounted to the frame of the snowblower and actuated using an idler wheel connected to the levered wheel via a cable and pulley system; when actuated the levered wheel raises one side of the snowblower and provides a pivot point about which the other side of the snowblower can be pivoted. An apparatus for deflecting the hot exhaust of the snowblower's engine into the base of the snow exhaust chute to prevent and clear clogs therein and an adjustable apparatus for partially covering the opening of the auger housing to effect the force applied to the snow to be collected and cleared through the snow exhaust chute are also provided.

15 Claims, 2 Drawing Sheets

SNOWBLOWER

BACKGROUND OF THE INVENTION

1. Field of the Invention

The present invention relates to improvements in the steering and operation of tracked vehicles. More particularly, the present invention relates to a method and apparatus for steering a two-wheel or track-driven snowblower thereby reducing the effort required to operate the vehicle.

2. Description of the Prior Art

Powered snowblowers have been in service for many years. There are essentially two basic types of snowblowers, a one stage and a two stage blower. A one stage snowblower usually has a sub-frame and a housing connected to the sub-frame. The housing has a front opening where the snow is taken in between spaced apart side walls. An engine is mounted on the sub-frame and an impeller is journalled into the side walls of the housing and is rotated by a direct drive mechanism connected to the engine. In a one stage snowblower the impeller is the only powered device used for collecting the snow and throwing the snow out the snowblower's snow exhaust chute.

A two stage snowblower is similar to a one stage snowblower in that it has a sub-frame with an attached housing which has spaced apart side walls and an engine mounted to the sub-frame. However, a two stage snowblower uses an auger journalled between the spaced apart side walls of the housing to collect the snow to be brought into the housing. The auger is generally a pair of opposing helical flights which in a first stage rotate to force the snow into an opening in the rear of the housing. In the second stage a fan is located near the opening which forces the snow up and out of the snow exhaust chute. Hence, the name two-stage snowblower.

With respect to both types of snowblowers, but in particular with respect to the two stage snowblowers, there have been attempts to improve the performance of the snowblower by altering certain characteristics or by adding features which will perform additional functions. Some of these improvements have related specifically to improving the steering of snowblowers. Prior to the present invention there are no known inexpensive, simple solutions to reduce steering effort and easily steer a snowblower or other hand operated tracked vehicle. Typically, the operator was left to "strong-arm" the machine in order to effect a turn. However, snowblowers can weigh as much as several hundred pounds and can thus be very difficult to turn using only human power especially for the elderly. This is usually due to the fact that most snowblowers have no provisions for turning, steering, or altering the direction of the track drive employed to move the snowblower. The wheels of a wheeled snowblower, as well as the tracks of a track-driven snowblower, are usually designed to move in a single direction—straight forward motion. However, the prior art does not address these problems and therefore there are few inexpensive, simple handling or steering devices available to improve the overall handling or steering performance of snowblowers.

An example of an attempted improvement is Thorud et al, U.S. Pat. No. 4,694,594. Thorud et al. is related to an improvement in the impeller of a single stage snowblower which has a central section which performs a snow throwing function and end sections which perform a snow collecting function to feed the snow to the central snow throwing section. Another example of an improved snowblower is U.S. Pat. No. 4,836,320 to Sundin. Sundin relates to a device for improving the turning of a handle-operated snowblower. Sundin teaches the use of pads mounted to the frame of the snowblower so that the weight of the snowblower may be tilted onto the pads and the snowblower can then be pivoted to redirect the snowblower's line of travel. While the Sundin teachings attempt to solve the problems with the prior art, the device still requires significant operator effort to shift the entire weight of the snowblower onto the pads and to then redirect the snowblower.

In addition to the type of lifting, tilting and dragging type steering apparatus disclosed in Sundin, the prior art discloses expensive and heavy duty rear-drive differentials and/or transmissions in order to engage or disengage power to the drive wheels or track on one side of the snowblower in order to effect a turn of the snowblower. The same type of turn has been accomplished in snowblowers having power-driven wheels or tracks through the use of expensive brake devices wherein a braking force is applied to one side of the snowblower so that the wheel or track on the non-braked side of the snowblower is caused to drive around the braked side of the snowblower in order to turn the machine. However, as noted, these types of devices are expensive, heavy, and usually have a relatively poor turning radius.

Another attempted handling or steering improvement to snowblowers is that disclosed in U.S. Pat. No. 4,756,101 to Friberg et al. Friberg et al. teach an apparatus for adjusting the position of the rear wheels with respect to the center of gravity of the snowblower in order to make it easier to adjust the cutting depth of the snowblower in certain snow conditions. To achieve a shift of the wheels with respect to the center of gravity, Friberg et al. teach the use of a linkage system connected to the axle on which the wheels are mounted. The axle is then pivoted with respect to the frame of the snowblower to a point where the wheels are just under or in front of the center of gravity, thereby making it easier to tilt the machine and adjust the depth of cut to be taken by the auger.

Additionally, it would be advantageous to improve the performance of the snow exhaust chute in order to prevent clogs therein. An example of this type of improvement to a snowblower is illustrated in U.S. Pat. No. 3,465,455 to Kiernan. Kiernan involves a snowblower having an auger in a housing and a fan to blow the snow out of an exhaust chute. Sometimes, when the snow is very wet and heavy, the exhaust chute can become clogged. In order to prevent clogs in the snow chute, it is advantageous to heat the snow chute in order to melt the clogged snow and thereby clear the chute. Thus, Kiernan teaches the pumping of the engine's hot exhaust gases into a jacket surrounding the exhaust chute in order to warm the snow exhaust chute.

Other examples of improvements to snowblowers are: U.S. Pat. No. 2,261,732 to O'Brien; U.S. Pat. No. 3,189,021 to Giguere; U.S. Pat. No. 4,978,068 to Eldridge; and U.S. Pat. No. Re 33,726.

Thus, while the prior art has recognized some of the limitations and problems associated with snowblowers, it is apparent that there is a need for further improvements. This is especially true with respect to the steering and the performance of such snowblowers.

SUMMARY OF THE INVENTION

The present invention relates to an improved snowblower. In particular the present invention relates to a wheeled or track-driven, handle operated snowblower having an auxiliary mechanism for assisting in the steering or handling of the snowblower, provisions for clearing and preventing clogs in the snow exhaust chute, as well as an adjustable cover for adjusting the front opening of the auger housing.

It is an object of the present invention to provide a handle operated, track-driven or wheeled snowblower which has superior handling and steering capabilities, so that the direction of the snowblower can be easily changed, whereby the time and effort taken to clear a given amount of snow can be reduced.

It is a further object of the present invention to provide a cost-effective snowblower having an apparatus which is capable of off-loading the weight of the snowblower from one side of the snowblower onto a pivot wheel to provide a reduced effort for steering or handling the snowblower.

It is still a further object of the present invention to provide a more cost-effective snowblower having a pivot wheel attached to the frame of the snowblower which is pivotable about an axis which is perpendicular to the direction of travel, the pivot wheel itself being aligned with the direction of travel of the snowblower, so that the turning radius and the amount of handling effort required to turn the snowblower is greatly reduced.

It is still a further object of the present invention to provide a snowblower having a hand-operated lever mechanism for selectively operating a pivot wheel between a first position, in which the pivot wheel is retracted, and a second position, in which the pivot wheel is extended and off-loads the weight of the snowblower for the respective side.

It is still a further object of the present invention to provide a snowblower in which two pivot wheels are mounted on opposite sides of the center of gravity of the snowblower in order to facilitate handling of the snowblower and provide for turning in more than one direction.

It is still a further object of the present invention to provide a snowblower having a lever mechanism for selectively operating both pivot wheels independently of each other.

It is still a further object of the present invention to provide a snowblower having a lever mechanism for selectively operating both pivot wheels simultaneously so that both pivot wheels can be extended at the same time.

It is still a further object of the present invention to provide a mechanism for safely operating the auger clutch and the wheel clutch with one hand while the snowblower is being redirected.

It is still a further object of the present invention to provide a snowblower with an exhaust bypass passage for selectively warming the snow exhaust chute of a snowblower in order to prevent clogs therein and/or to melt clogs which have formed therein.

It is still a further object of the present invention to provide a snowblower having an adjustable cover for selectively adjusting the size of the opening in the auger housing of the snowblower in order to provide for a greater force on the snow being blown thereby decreasing the likelihood of the snowblower's snow exhaust chute becoming clogged.

Other objects and advantages of the present invention will become apparent from the following detailed description of the invention with reference being made to the appended drawings.

DETAILED DESCRIPTION OF THE PREFERRED EMBODIMENT

Figure 1:
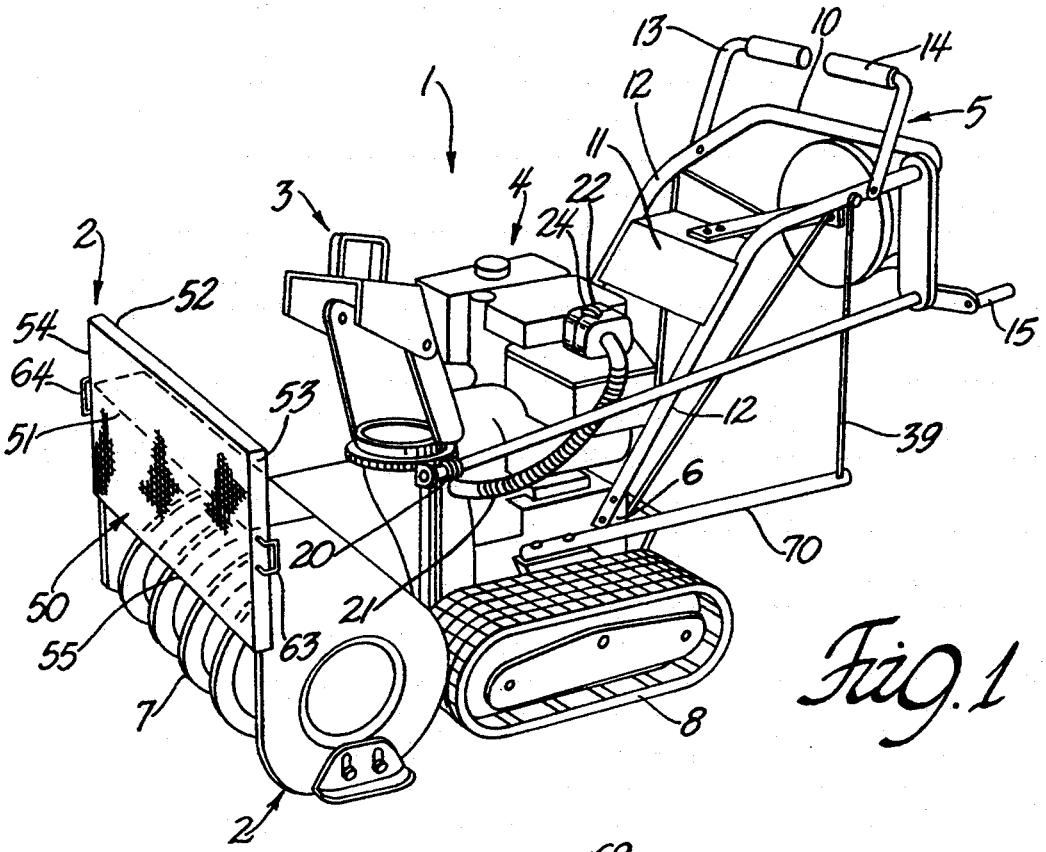
FIG. 1 is a perspective view of a track-driven, two-stage snowblower according to the present invention.

Referring generally to the drawings, an improved snowblower 1 is shown. The snowblower 1 typically includes a forward mounted auger housing 2, used to collect the snow; a snow exhaust chute 3, used to direct the blown snow; an engine 4; a handling assembly 5, used to maneuver the snowblower 1; and a frame 6 to which all of the above are attached. The engine 4 is used to power a snow gathering auger 7 located in the auger housing 2, and to power the drive mechanism by which the snowblower 1 is driven.

Figure 3:
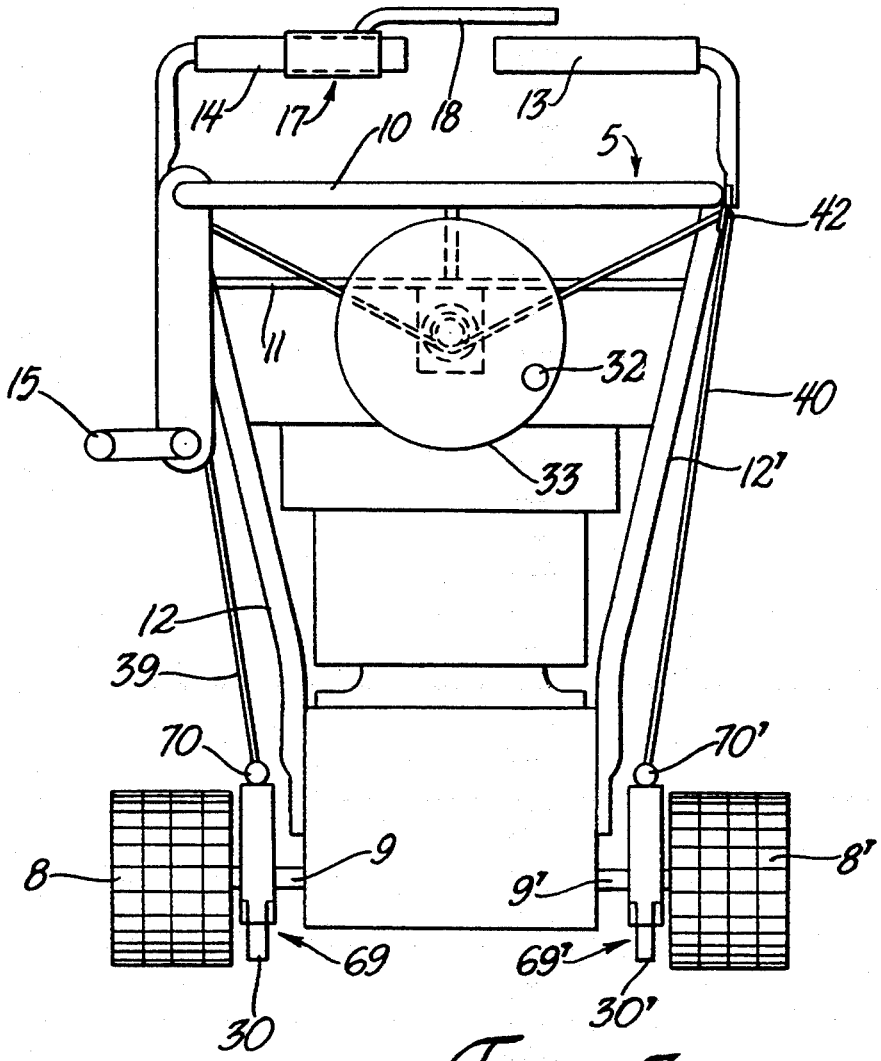
FIG. 3 is a rear elevational view of the present invention.

In the embodiment shown, the snowblower 1 is made mobile through the use of track-drives 8 and 8'. The track-drives 8 and 8' are located on each side of the engine 4 and are connected to the frame 6 of the snowblower 1 through parallel shafts 9 and 9', as shown in FIG. 3. Each track-drive 8 and 8' is powered by an engine 4 through a power take-off unit (not shown). It is also possible to use the present improvements for snowblowers having wheels instead of track-drives.

Some snowblowers are not self-propelled while other snowblowers are self-propelled through the use of a direct drive mechanism connected to the track-drive or wheels of the snowblower. Some direct drive mechanisms power the track-drive or wheels on both sides of the snowblower equally, while others will only drive one side, while yet others can be made to vary the amount of power to each side so that handling, i.e. turning of the snowblower may be made easier. However, most of these systems are heavy, cumbersome and very costly. In the present invention, the snowblower's turning is improved by using a hand wheel operated lever mechanism wherein a wheel 30 is used as a pivot to unload the weight on a side of the snowblower 1 from one of the tracks 8 and 8', and to allow the other track to be powered around the pivot wheel 30 and 30'.

The snowblower's handling assembly 5 is attached to the frame 6 near the rear of the snowblower 1, and tilts upward and backward. The handling assembly 5 is composed of a handling bar 10 which has a pair of legs 12 straddling the engine and integral with the handling bar 10 as well as substantially parallel to each other. The legs 12 are connected at one end to the frame 6. A brace 11 is connected between the legs 12 of the handling bar 10 to provide stability and rigidity to the handling assembly 5 so that forces applied to the handling bar 10 are efficiently transferred to the frame 6. The handling assembly 5 also serves as a base to which is mounted an auger clutch handle 13, used to engage the auger 7; a track-drive clutch handle 14, used to engage the track-drive to propel the snowblower forward; a snow exhaust chute adjustment handle 15; and a hand wheel operated actuating device 31 used to operate the levered wheels 30 and 30'.

Figure 4:
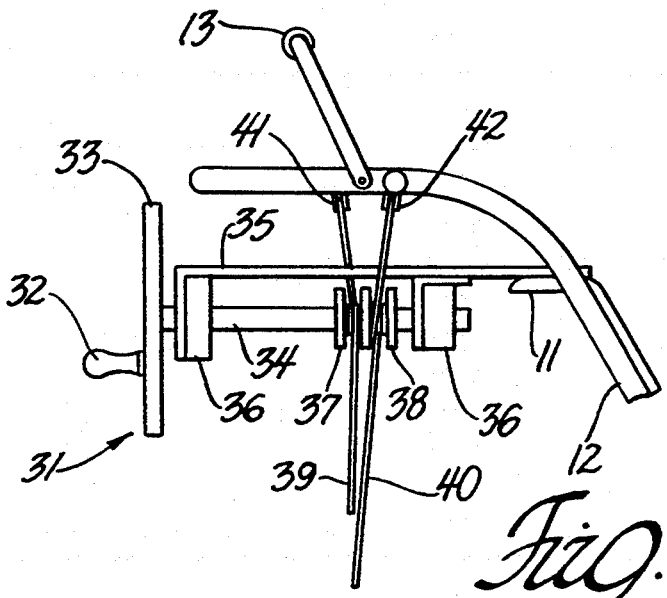
FIG. 4 is a side view of the handling bar of the snowblower with the actuating system of the present invention mounted thereon.

The improved steering system is primarily composed of two components. The first is the hand wheel and associated cable and pulley mechanism which is used to actuate or move the levered wheels 30 and 30'. The second component is made up of the pivot wheel assemblies 30 and 30' and a lever mechanism used to pivot the wheels into and out of contact with a ground surface. The actuating device 31, see FIG. 4, is, in the preferred embodiment, a cable and pulley system in which a handle 32 is connected to an idler wheel 33 which has a shaft 34 connected at its center. The shaft 34 is carried by a support bar 35 which has one end connected to the brace 11 and the other end connected to the handling bar 10 through the use of appropriate retainers, i.e., bolt and nut, such that the handle 32 of the idler wheel 33 can be easily accessible to the operator of the snowblower 1. The shaft 34 is journalled to mounting plates 36 so that it may rotate about its longitudinal axis. The shaft 34 has spools 37 and 38 which are used to guide cables 39 and 40, respectively.

The cables 39 and 40 have one end fastened to the spools 37 and 38, respectively, and pass through respective pulleys 41 and 42. The pulleys 41 and 42 are connected to the handling bar 10 at a point near the clutch handles 14 and 13. Thus, each pulley is on one side of the snowblower and each cable is sent to the opposite side of the snowblower and passes through the pulley on that side. Once each cable passes through its respective pulley, it then is connected to a lever mechanism 69 and 69', respectively.

Figure 2A:
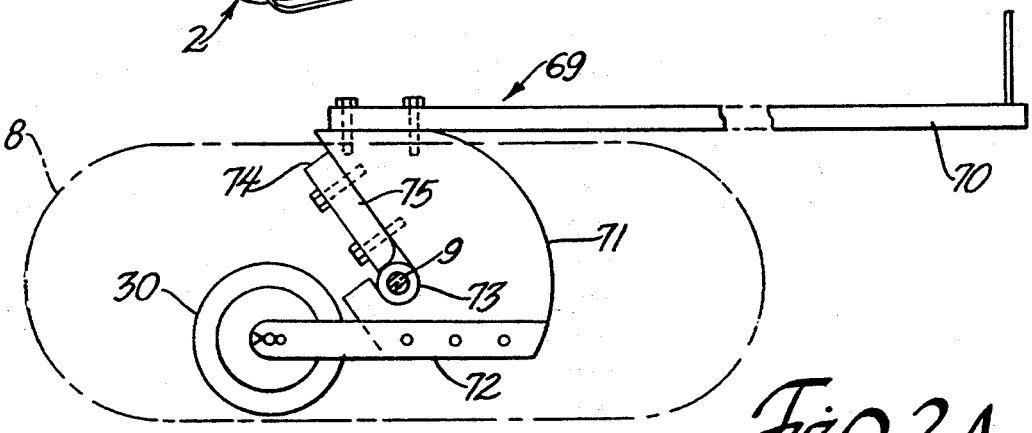
FIG. 2A is a side elevational view of the pivot wheel assembly of the present invention in a retracted position mounted on a track-driven snowblower.
Figure 2B:
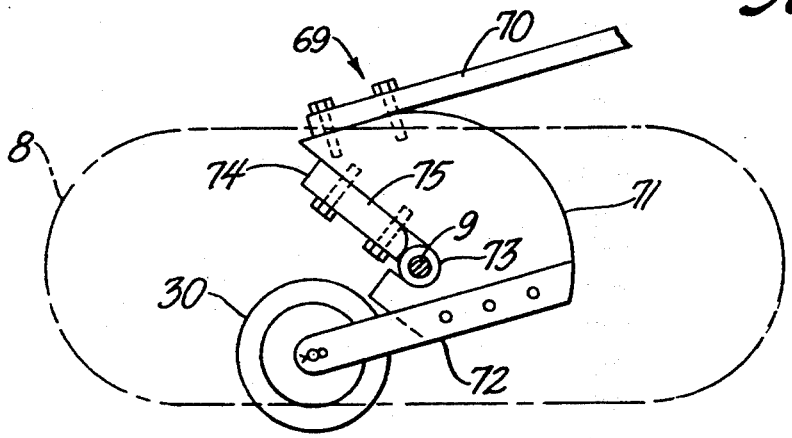
FIG. 2B is a side elevational view of the pivot wheel assembly of FIG. 2A in an extended position mounted on a track-driven snowblower.

The lever mechanisms 69 and 69' are mirror images of each other. Accordingly, discussion will be limited to the lever mechanism 69 depicted in FIGS. 2A and 2B. The lever mechanism 69 is composed of a lever bar 70 connected to one edge of a sector body 71; a wheel bar 72 connected to the bottom edge of the sector body 71; and the levered wheel 30 connected to an end of the wheel bar 72. The cable 39 is connected to the lever bar 70 at the end of the bar furthest away from the sector body 71. Additionally, in the preferred embodiment shown in FIGS. 2A and 2B, the lever bar 70 and the wheel bar 72 are connected to the sector body 71 through the use of a plurality of bolts and screws, respectively.

The sector body 71 has an elongated slot 73 which is adapted to receive the shaft 9 which connects the track-drive 8 to the snowblower 1. Once the shaft 9 has been located within the slot 73, a guide block 74 is bolted to the sector body 71 within the slot 73 so that movement of the shaft 9 is restricted within the slot 73. The guide block 74 has an end 75 which is preferably rounded to reduce the frictional contact when the sector body 71 is pivoted about the shaft 9. The shaft 9 serves as a fulcrum point for the levered wheel 30 and the lever bar 70 such that as the cable 39 is taken up by the spool 37 and the cable 39 lifts the end of lever bar 70 making it rise in the vertical direction, the levered wheel 30 pivots about the shaft 9 and moves downward in the vertical direction to contact the ground causing the shaft 9 to move upward in the vertical direction such that the respective track on that side of the snowblower is lifted off the ground.

As shown in FIG. 3, the lever mechanism 69 is preferably positioned between the track-drive 8 and the frame 6 of the snowblower. This location shields the lever mechanism 69 and its component parts from exterior influences and provides for a superior turning capability, thereby substantially limiting the effort required to change the direction of the snowblower. However, it is possible to locate the lever mechanism outside of the track-drive mechanism.

Thus, in operation, when the operator of the snowblower 1 desires to turn the snowblower, the operator turns the idler wheel 33 in the clockwise or counterclockwise direction depending on whether it is a right or left turn. This causes the cable 39 to be taken up by the spool 37 and the cable 39 is made to act on the end of lever bar 70 making the end of the lever bar 70 rise in the vertical direction, the levered wheel 30 thereby moves downward in the vertical direction and contacts the ground causing the shaft 9 to move upward in the vertical direction and the respective side track of the snowblower to be lifted off the ground. The snowblower can then be manually pivoted about the levered wheel, or preferably, the remaining track-drive or wheel still in contact with the ground continues to be driven by the engine drive to steer the snowblower about the levered wheel 30. Once the snowblower has been turned in the desired direction, the idler wheel 33 can then be returned to the starting position where both levered wheels 30 and 30' are in the retracted position. The same is true for the opposite side of the snowblower, but the idler wheel 33 is turned in the clockwise direction in order to take up the cable 40.

In an alternative embodiment (not shown) it is contemplated that the actuating device 31 employed in the preferred embodiment may be replaced using an electrically operated motor-driven system to selectively turn the idler wheel 33 so that the levered wheels 30 and 30' are brought into engagement with the ground, thereby eliminating the need to hand operate the idler wheel employed in the preferred embodiment. It is also contemplated that the cable and pulley system may be modified such that both levered wheels 30 and 30' are in an extended position at the same time so as to remove both tracks from contact with the ground. It is also possible to provide for straps (not pictured) which would connect the lever bars 70 and 70' to the legs 12 on the handling bar such that both levered wheels 30 and 30' are locked in the extended position. This is advantageous because once the snowblower's weight is carried by both levered wheels rather than the tracks, it is much easier to manually transport the snowblower and to manually turn the snowblower when there is no power to the tracks 8 and 8' as is the case when the engine is shut off.

In yet another alternative embodiment, a slidable sleeve 17, shown in FIG. 3, is used to simultaneously operate both the auger clutch handle 13 and the track drive clutch handle 14, using only one hand so that the operator's other hand is free to operate the actuating device 31. Without a slidable sleeve 17, either the auger clutch handle 13 or the track drive clutch 14 must be released. It is possible to lock one of these clutches in position such that the clutch is continuously engaged; however, this results in an unacceptable safety hazard.

In order to avoid this safety hazard yet provide both independent and coupled operation of the auger clutch handle 13 and the track drive clutch handle 14, the slidable sleeve 17 is attached to the track drive clutch handle 14 and has an end portion 18 which, when the slidable sleeve 17 is moved to the right, extends over the auger clutch handle 13. Thus, when the snowblower is in the one hand operational mode, i.e. the slidable sleeve 17 is moved to the right so that the end portion 18 is positioned above the auger clutch handle 13, and the drive track clutch handle 14 is depressed the end portion 18 of the slidable sleeve 17 contacts the auger clutch handle 13 and causes it to also engage. This allows for one hand operation of both clutches and is safe in that when the track drive clutch handle 14 is released both the snowblower and the auger will stop. When the slidable sleeve 17 is moved to the left so that the end portion 18 will not engage the auger clutch handle 13, both the auger clutch handle 13 and the track drive clutch handle 14 can be independently operated.

Also included in the improved snowblower 1 is a device for preventing and clearing clogs in the snow exhaust chute which may occur at the base 20 of the snow exhaust chute 3. In two-stage snowblowers, the snow is gathered by an auger which forces the collected snow to the back of the auger housing. At this point the collected snow is blown into the snow exhaust chute, where the snow is directed for deposit external to the device. Depending on the depth and condition of the snow, in particular, whether the snow is very light and fluffy or whether the snow is very wet and, therefore, very heavy and packable, the collected snow may become packed at the back of the auger housing near the base of the snow exhaust chute, so that the system becomes blocked and must be cleared. However, for obvious reasons clearing the system can be very dangerous.

In order to properly and safely clear a blockage in the snow exhaust chute, it is necessary to first turn the snowblower off so that all of the functioning parts stop moving. It is then necessary to determine the spot at which the clog has occurred and then all of the blocking snow must be manually removed. Then the snowblower may be restarted and the snow clearing may continue. However, if the snow exhaust chute has become blocked once, it will probably become blocked again. Thus, the present invention may be augmented to use the hot exhaust gases of the engine 4 by piping them to a point in the base 20 of the snow exhaust chute 3. This is accomplished through the use of a hose 21 which is connected to a muffler 22 of the engine 4.

It should be noted that when the snow is very light and fluffy and therefore not susceptible to clogging, it may be advantageous to not have the exhaust gases of the engine 4 warm the base 20 of the snow exhaust chute 3. Therefore, the muffler 22 includes a switch 24 which can be used to select whether the hot exhaust gases of the engine are allowed to bypass the hose 21 or whether they are caused to be routed through the hose 21 into the base 20 of the snow exhaust chute 3. Additionally, even if the snow is of a type which would usually clog the snow exhaust chute 3, it may be advantageous not to have the hot exhaust gases from the engine 4 warm the base 20 of the snow exhaust chute until it actually becomes clogged. The specific design presented here is flexible in order to allow the operator of the snowblower to decide which is the best option.

As the snowblower 1 is driven forward, either by a self-propulsion system or manually by the operator, the opening in the front of the auger housing 2 leads the snowblower 1 into the snow to be removed. The auger housing 2 is made up of two side walls, the auger 7 is journalled between the side walls of the auger housing, and a back wall which has an opening in the middle (not pictured). The auger 7 is usually a pair of oppositely orientated helical flights turning in the same direction to cause the collected snow to be forced toward the center and back of the auger housing. Once the snow reaches the back of the auger housing, it is blown by the blower (not shown) up through the snow exhaust chute and away from the snowblower. The force applied to the snow by the blower is a function of the effective cross sectional area of the frontal opening in the auger housing. This is because as the blower (not shown) blows the snow up through the snow exhaust chute 3, air is drawn from within the auger housing to accomplish this function. In order to increase the force with which this air is drawn and thereby the force with which the collected snow is drawn, it is necessary to decrease the effective cross sectional area of the frontal opening of the auger housing 2. However, the frontal opening's size must not be reduced such that it prevents the snow to be collected from getting into the auger housing.

The present invention can be easily adapted to provide the additional feature of a cover 50 which is adjustably mounted to the auger housing. The cover 50 has a cover plate 51 which forms the base of the cover 50 and primarily serves to adjust the size of the frontal opening of the auger housing 2. The cover 50 is connected to the auger housing 2 through the use of clamps 63 and 64 connected to the sides of the auger housing 2. The cover 50 is positioned such that there is room for the auger 7 to rotate without contacting the cover 50.

The cover plate 51 has a top edge member 52 connected at the edge of the cover plate 51 near the top of the auger housing and at approximately a right angle so that the top edge member 52 acts as a stop when the cover is in a fully closed position. The cover plate also has a pair of side plate members 53 and 54 connected to the cover plate 51 at the edges of the cover plate 51 near the side walls of the auger housing 2. The side plate members 53 and 54 are pictured as being positioned on the outside of the auger housing side walls. It should be noted that in an alternative embodiment (not shown) it is possible to have the side plate members on the inside of the auger housing side walls and to cut slots in the top of the auger housing for the side plate members 53 and 54 to pass through.

In operation, the cover 50 is positioned and locked in place using the clamps 63 and 64 so that a bottom edge 55 of the cover plate 51 is above the height of the snow to be collected. Additionally, it should be noted that the cover 50 for the auger housing 2 also serves as a safety device because it helps to shield the dangerous components of the auger housing from easy accessibility.

While the invention has been described with respect to snowblowers, it is to be appreciated that the steering apparatus thereof might equally be applied to a number of other handle-operated track or wheel driven machines. Accordingly, the scope of the above described invention is to be limited only by the following claims.

What is claimed is:

1. An apparatus for the steering of a wheeled or a track-driven machine having a frame, said machine adapted to be operated on a ground surface, said machine having a handling bar, a first side, and an oppositely disposed second side, said first side of said machine having a first mobilizing means and said second side of said machine having a second mobilizing means, said apparatus comprising:

at least one levered wheel attached to said first side of said machine; and means for moving said at least one levered wheel between a first position in which said first mobilizing means does not engage said ground surface and a second position in which said at least one levered wheel engages said ground surface such that said first side of said machine is elevated from said ground, said first mobilizing means does not contact said ground surface, and said second side of said machine is substantially pivoted about said at least one levered wheel.

2. The apparatus of claim 1 further comprising:

a first levered wheel of said at least one levered wheel located on said first side of said machine;

a second levered wheel of said at least one levered wheel located on said second side of said machine; and wherein said means for moving said at least one levered wheel between said first and said second positions comprises:

means for selectively operating each said first and said second levered wheels between respective first positions and second positions, said operating means independently connected to said first and said second levered wheels.

3. The apparatus of claim 2 wherein said first and said second mobilizing means each comprises a wheel attached to said machine; wherein said first levered wheel is positioned between said first mobilizing means and said frame and said second levered wheel is positioned between said second mobilizing means and said frame, said apparatus further comprising:

means for attaching said operating means to said first and said second levered wheels;

first means for locking said first levered wheel in said first position; and second means for locking said second levered wheel in said first position.

4. The apparatus of claim 3 wherein said operating means comprises:

a rod having a first end connected to said handling bar and a second end;

a first spool disposed on said rod;

a second spool disposed on said rod;

a disc having a center point, said second end of said rod connected to said disc at said center point; and a handle member mounted to said disc; said means for attaching said operating means to said first and said second levered wheels comprising:

a first cable having a first end attached to said first spool and a second end attached to said first levered wheel;

a second cable having a first end attached to said second spool and a second end attached to said second levered wheel;

a first pulley attached to said handling bar, said first cable passing over said first pulley; and a second pulley attached to said handling bar, said second cable passing over said second pulley.

5. The apparatus of claim 1 further comprising:

a frame assembly;

an auger housing having a top, a side, and an opening, said auger housing connected to said frame assembly;

a chute comprising a first end connected to said top of said auger housing and a second end extending in a direction away from said auger housing, said chute having an inlet port located therein proximate said first end of said chute;

an auger adapted to push snow into said auger housing, said auger being disposed in and connected to said auger housing;

an engine mounted on said frame assembly between said first and said second mobilizing means and adapted to operate said auger;

an exhaust muffler mounted to said engine; and an exhaust hose having a first end connected to said exhaust muffler and a second end connected to said inlet port located in said first end of said chute, whereby when said engine is started the hot exhaust gases of said engine are directed into said chute and any snow clogging said chute is melted by said hot exhaust gases.

6. The apparatus of claim 5 further comprising an exhaust deflector valve having a first side connected to said exhaust muffler of said engine and a second side connected to said exhaust hose.

7. The apparatus of claim 5 further comprising:

a cover plate covering a portion of said opening of said auger housing; and an adjustable clamp assembly connecting said cover plate to said auger housing, whereby said cover plate can be adjusted to create a variable size frontal opening on the front of said auger housing, thereby increasing or decreasing the force acting on the snow brought into said auger housing.

8. The apparatus of claim 7 wherein said cover plate is larger than said frontal opening of said auger housing.

9. The apparatus of claim 5 wherein said auger housing has a frontal opening, said apparatus further comprising:

a cover plate having a top edge, a first side edge, and a second side edge, said cover plate juxtaposed said frontal opening of said auger housing and wherein said auger housing further comprises:

a top wall connected to said cover plate at said top edge;

a first side wall connected to said cover plate at said first side edge;

a second side wall connected to said cover plate at said second side edge; and means for adjusting the position of said cover plate relative to said frontal opening of said auger housing, whereby said adjusting means permits movement of said cover plate to permit the size of said frontal opening of said auger housing to be varied, thereby affecting the force acting on the snow brought into said auger housing.

10. The apparatus of claim 9 wherein said cover plate is larger than said frontal opening of said auger housing.

11. An improved snowblower having a handling bar, a frame having a first side and a second side, said first side of said snowblower having a first mobilizing means and said second side of said snowblower having a second mobilizing means, wherein the improvement comprises:

a levered wheel having a fulcrum point, said levered wheel attached to said first side of said frame at said fulcrum point; and means for moving said levered wheel between a first position in which said levered wheel does not contact the ground and a second position in which said levered wheel contacts the ground and said first mobilizing means does not contact said ground, said moving means being attached to said snowblower and said levered wheel.

12. The snowblower of claim 11 further comprising:

a first levered wheel located on said first side of said snowblower; and a second levered wheel located on said second side of said snowblower; and wherein said means for moving said levered wheel between said first and said second positions comprises:

means for selectively operating each said first and said second levered wheels between their respective first position and second position, said operating means being independently connected to said first and said second levered wheels.

13. The snowblower of claim 12 wherein said first and said second mobilizing means each comprise a track-drive assembly attached to said snowblower, said snowblower further comprising:

means for independently attaching said operating means to said first and second levered wheels.

14. The snowblower of claim 13 wherein said operating means comprises:

a rod having a first end connected to said handling bar and a second end;

a first spool disposed on said rod;

a second spool disposed on said rod;

a disc having a center point, said second end of said rod being connected to said disc at said center point; and a handle member mounted to said disc at a point juxtaposed said center point of said disc; said means for attaching said operating means to said first and second levered wheels comprising:

a first cable having a first end attached to said first spool and a second end attached to said first levered wheel;

a second cable having a first end attached to said second spool and a second end attached to said second levered wheel;

a first pulley attached to said handling bar, said first cable passing over said first pulley; and a second pulley attached to said handling bar, said second cable passing over said second pulley.

15. An apparatus for covering an opening of an auger housing of a snowblower adapted to be operated on a ground surface, said snowblower having a handling bar, a first side, and an oppositely disposed second side, said first side of said snowblower having a first mobilizing means and said second side of said snowblower having a second mobilizing means, said apparatus comprising:

a cover plate covering a portion of said opening of said auger housing; and an adjustable clamp assembly connecting said cover plate to said auger housing, whereby said cover plate can be adjusted to create a variable size frontal opening on the front of said auger housing, thereby increasing or decreasing the force acting on the snow brought into said auger housing.

* * * * *